US011639602B2

(12) United States Patent
Del Rio et al.

(10) Patent No.: US 11,639,602 B2
(45) Date of Patent: May 2, 2023

(54) CONNECTOR AND METHOD OF USE OF SAME

(71) Applicant: Blokable, LLC, Sacramento, CA (US)

(72) Inventors: Nelson Luis Del Rio, Redding, CA (US); Timothy Bryce Miller, Seattle, WA (US); Abdullah N. Alqarni, Seattle, WA (US); Alan Michael Tonissen, Lake Forest, CA (US); Andrea Mae Chiu, Irvine, CA (US); Daniel W. Hartford, Newcastle, WA (US); Molly Marie Skinner, Huntington Beach, CA (US); Nicholas A. Palladino, Seattle, WA (US); Roger Paul Young, Trabuco Canyon, CA (US); Xianghui Chen, Irvine, CA (US)

(73) Assignee: Blokable, LLC, Sacramento, CA (US)

( * ) Notice: Subject to any disclaimer, the term of this patent is extended or adjusted under 35 U.S.C. 154(b) by 10 days.

(21) Appl. No.: 17/086,157

(22) Filed: Oct. 30, 2020

(65) Prior Publication Data

US 2021/0131093 A1 May 6, 2021

Related U.S. Application Data

(60) Provisional application No. 62/929,698, filed on Nov. 1, 2019.

(51) Int. Cl.
*E04B 1/38* (2006.01)
*E04B 1/58* (2006.01)

(52) U.S. Cl.
CPC ..... *E04B 1/5831* (2013.01); *E04B 1/585* (2013.01); *E04B 2001/5887* (2013.01)

(58) Field of Classification Search
CPC ..... E04B 1/1903; E04B 1/348; E04B 1/38; E04B 1/40; E04B 1/4107; E04B 1/5831;
(Continued)

(56) References Cited

U.S. PATENT DOCUMENTS 1,739,740 A * 12/1929 Stoeltzlen ..... H01R 4/5025 403/370
4,566,246 A * 1/1986 Sanger ..... E04B 1/34384 52/81.3

(Continued)

FOREIGN PATENT DOCUMENTS

CN 108532829 A 9/2018
JP 2002022176 A 1/2002

(Continued)

OTHER PUBLICATIONS

International Search Report and Written Opinion for PCT/US2020/058408, dated Mar. 9, 2021, 18 pages.

*Primary Examiner* — William V Gilbert
(74) *Attorney, Agent, or Firm* — Cozen O'Connor

(57) ABSTRACT

A connector includes a first body, a second body, a first fastener, and a second fastener. The first body has a base portion and a protrusion, the protrusion extends away from the base portion along a first direction, and the first body has a first cavity that extends into the protrusion and towards the base portion along the first direction. The second body has a second cavity, which is shaped to receive the protrusion such that rotation of the first body relative to the second body is blocked. The connector may be used to attach structural members, for example during the construction of a modular structure.

23 Claims, 13 Drawing Sheets

(58) Field of Classification Search
CPC ..... E04B 1/585; E04B 2001/5887; E04B 2001/2421; E04B 1/21; F16B 7/18; F16B 7/182; F16B 7/185; B65D 90/0006; B65D 90/00
USPC ..... 52/655.1
See application file for complete search history.

(56) References Cited

U.S. PATENT DOCUMENTS

| | | | | |
|---|---|---|---|---|
| 2001/0015045 | A1 | 8/2001 | Paroly | |
| 2011/0095527 | A1* | 4/2011 | Miyoshi | F16B 7/185 285/334.1 |
| 2011/0107715 | A1* | 5/2011 | Cooke | F16B 21/02 52/698 |
| 2015/0292194 | A1 | 10/2015 | Calafatis et al. | |
| 2017/0362811 | A1* | 12/2017 | King, Jr. | F16B 12/40 |
| 2018/0051739 | A1* | 2/2018 | Cheng | A47H 1/022 |
| 2018/0187418 | A1* | 7/2018 | Prowse | E04C 5/165 |
| 2019/0249700 | A1* | 8/2019 | Deng | F16B 7/0473 |
| 2019/0257070 | A1 | 8/2019 | Grosch et al. | |
| 2020/0308826 | A1* | 10/2020 | Miller | E04B 1/40 |

FOREIGN PATENT DOCUMENTS

| | | | |
|---|---|---|---|
| JP | 2018145786 | A | 9/2018 |
| KR | 101149602 | B1 | 5/2012 |
| KR | 101320774 | B1 | 10/2013 |
| WO | 2019213439 | A1 | 11/2019 |

* cited by examiner

CONNECTOR AND METHOD OF USE OF SAME

BACKGROUND

Technical Field

The present disclosure relates generally to modular structure construction, and specifically to connectors used during the construction of said modular structures.

Description of the Related Art

In recent years, the availability of affordable housing has become an issue for many communities around the country and throughout the world. Certain segments of the population, such as the poor or elderly, may be especially susceptible to the increased cost and decreased availability of housing. As a result, many people are either living in substandard housing or are forced to commute long distances to work at their jobs.

One of the issues exacerbating this housing crisis is the amount of time and resources that are necessary to construct a single family home or a multi-unit dwelling. Such constructions times can take anywhere from several weeks to several months or more, and may require teams of workers and contractors to construct a home or dwelling at a construction site.

In addition to time constraints, current building practices rely upon a division of labor and responsibilities to incorporate technology into the home or dwelling unit. As such, a primary contractor may be responsible for erecting the structural components that are used to modify walls or other structural components to incorporate various types of technologies and capabilities, including networking, communications, and sensing capabilities, into the structure.

Modular structures may be used to decrease construction time for various types of dwelling units. At least portions of such modular units may pre-fabricated at a facility located away from the construction site, and shipped to the construction site to be quickly and efficiently incorporated into the modular structure. Because such portions may be pre-fabricated to be included within multiple types of modular structures, the cost of such fabrication may be kept relatively low. One example of a known modular structure is described in PCT Application No. PCT/US2019/030465, filed May 2, 2019, the disclosure of which is hereby incorporated in its entirety.

Referring to FIG. 1, a known modular structure 100 may have a length 106, a width 108, and a height 110. In some implementations, the modular structure 100 may also include a frame 112 and a floor 114. The frame 112 may be comprised of metal (e.g., steel), a composite material (e.g., oriented strand board, fiber reinforced polymers), or other materials. The frame 112 may extend through one or more of the length 106, the width 108, and/or the height 110 of the modular structure 100, and may delineate an interior portion 122 of the modular structure 100 from an exterior 124 of the modular structure 100. All or substantially all of the materials employed in the modular structure 100 may be fireproof or fire resistant (e.g., glass fiber reinforced sheetrock, steel, mineral wool) and/or may have a fire retardant coating or covering thereon.

The frame 112 may include one or more structural frame members 118. Each of the structural members of the frame 112 may extend along one or more of the length 106, width 108, and/or height 110 of the modular structure 100. The structural members may be used to outline a shape for the modular structure 100. For example, the structural members may include a set of vertical structural frame members 118*a*, a set of lower horizontal structural frame members 118*b*, and a set of upper horizontal structural frame members 118*c* that may be used to outline a three dimensional shape, such as a cuboid. As such, the set of lower horizontal structural frame members 118*b* may include a first pair of opposing lower horizontal structural frame members 118*b* that extend along the length 106 of the modular structure 100, and a second pair of opposing lower horizontal structural frame members 118*b* that extend along the width 108 of the modular structure 100.

The set of upper horizontal structural frame members 118*c* in such an implementation may include a first pair of opposing upper horizontal structural frame members 118*c* that extend along the length 106 of the modular structure 100, and a second pair of opposing upper horizontal structural frame members 118*c* that extend along the width 108 of the modular structure 100. The vertical structural frame members 118*a* in such an implementation may extend between the lower horizontal structure frame members 118*b* and the upper horizontal structural frame members 118*c*. In such an implementation, the set of lower horizontal members 118*b* may form a perimeter 120 of the modular structure 100. In some implementations, the structural members may be used to outline other types of shapes for the modular structure 100.

The dimensions of the modular structure 100 (e.g., the length 106, the width 108, and/or the height 110) may be based upon one or more criteria. Such criteria may reflect the environment and/or usage of the modular structure 100. For example, the dimensions of the modular structure 100 may be the same or substantially similar to the dimensions of one or more types of intermodal container (e.g., 20-foot containers or 40-foot containers) to facilitate transport via various modes of transportation (e.g., ships, trains, trucks) to a location. In such an implementation, the modular structure 100 may include other features or components that reflect the environment and/or usage of the modular structure 100. For example, in implementations in which the modular structure 100 has the same or substantially similar dimensions to a type of intermodal container, the modular structure 100 may include one or more couplers (e.g., twist lock fittings) at appropriate locations such that the modular structure 100 may be selectively, releaseably, physically coupled and secured to other intermodal containers for transport.

In some implementations, the modular structure 100 may include a floor 114 that extends across some or all of the length 106 and/or the width 108 of the modular structure 100 proximate a bottom portion 128 of the modular structure 100. The floor may be physically coupled to the frame 112 using one or more physical couplers (e.g., bolts, screws, nails, staples, adhesives). The floor 114 may include an upper surface 130 that faces toward the interior portion 122 of the modular structure 100 and an opposing lower surface 132 that faces toward the exterior 124 of the modular structure. The upper surface 130 may be separated from the opposing lower surface 132 by a thickness 134 of the floor 114 in which one or both of the upper surface 130 and the lower surface 132 may be substantially parallel to a horizontal plane. As such, the upper surface 130 may be used to support items located within the interior portion 122 of the modular structure.

In some implementations, the floor 114 may be supported by one or more support members that may extend across length 106 and/or the width 108 of the modular structure. For example, in some implementations, one or more metal beams may extend across the width 108 of the modular structure 100 along the bottom portion 128 of the modular structure 100. The lower surface 132 of the floor 114 may thereby rest on top of such support members.

A number of structural frame members 118 may be physically coupled together using a connector 150, as shown in the call out in FIG. 1. Each connector 150 may include a first leg 152 and a second leg 154 in which the first leg 152 and the second leg 154 are arranged at an angle to each other. The angle formed by the first leg 152 and the second leg 154 may be based, at least in part, on the shape of the modular structure 100. In implementations in which the modular structure 100 forms a cuboid, as shown in FIG. 1, the first leg 152 and the second leg 154 may be arranged at a ninety degree angle with respect to each other.

Each of the first leg 152 and the second leg 154 may have a respective cavity 156 (one shown) with an opening 158 that faces away from the connector 150. The opening 158 and/or the cavity 156 may be shaped and dimensioned to receive one of the structural frame members 118 in the modular structure 100. In some implementations, the opening 158 and/or cavity 156 may have dimensions that are only slightly larger than the outside dimensions of the structural frame member 118. As such the structural frame member 118 may form a close fitting or tight physical coupling with the opening 158 and/or cavity 156. In some implementations, one or more of the structural frame members 118 and the connector 150 may include a hollow cavity. In such implementations, such hollow cavities may be used to run one or more wires, cables, and/or optical fibers, as discussed below.

In some implementations, the connector 150 may have corresponding sidewall apertures 160 on opposing sidewalls of either or both of the first leg 152 and/or the second leg 154 (one shown in FIG. 1). Each pair of opposing sidewall apertures 160 may align with a corresponding frame member aperture 162 when the structural frame member 118 is inserted into the cavity 156. The frame member aperture 162 may extend through the structural frame member 118 such that the structural frame member 118 may be selectively, releasably, physically secured to the connector 150 by, for example, inserting a pin 164 through the opposing sidewall apertures 160 and the frame member aperture 162.

The connector 150 may include a post 166 that may be oriented in a vertical direction to be physically coupled to one of the vertical structural frame members 118*a*. In some implementations, the post 166 may be sized to be securely inserted into an opening 168 in the vertical structural frame member 118*a*. In some implementations, the vertical structural frame member 118*a* may include opposing sidewall apertures 162, and the post 166 may include a corresponding post aperture 170 that extends through the post 166. As such, the post 166 and the vertical structure frame member 118*a* may be selectively, releasably physically secured to the connector 150 via the post 166.

BRIEF SUMMARY

A connector that connects structural members within a structural block, and that also connects adjacent structural blocks may result in a more stable modular structure, as well as reduced costs due to a reduction in parts and labor used in the production of such modular structures.

According to one aspect of the disclosure, a connector includes a first body, a second body, a first fastener, and a second fastener. The first body has a base portion and a protrusion, the protrusion extends away from the base portion along a first direction, and the first body has a first cavity that extends into the protrusion and towards the base portion along the first direction. The second body has a second cavity, which is shaped to receive the protrusion such that rotation of the first body relative to the second body is blocked.

The first fastener has a third cavity, and the first fastener is securable within the first cavity such that translation of the first fastener relative to the first body is blocked. The second fastener has a proximal portion and a distal portion, and the distal portion is securable within the third cavity such that translation of the first fastener relative to the second fastener is blocked. The connector has an assembled configuration in which translation of the second body relative to the first body in the first direction is blocked, and rotation of the second body relative to the first body about the first direction is blocked.

According to another aspect of the disclosure, a method of constructing a modular structure includes inserting a first fastener into a first cavity, the first cavity defined by a first body having a base portion and a protrusion that extends away from the base portion along a first direction. The method further includes inserting the protrusion into a second cavity defined by a second body, and the second cavity is shaped to receive the protrusion such that rotation of the first body relative to the second body is blocked. The method further includes inserting a distal portion of a second fastener into a third cavity defined by the first fastener, thereby capturing the second body between the distal portion and a proximal portion of the second fastener. The distal portion is opposite the proximal portion with respect to the first direction According to one aspect of the disclosure, a method of assembling a connector includes inserting a first fastener into a first cavity, which is defined by a first body having a base portion and a protrusion that extends away from the base portion along a first direction. The method further includes inserting the protrusion into a second cavity defined by a second body, and the second cavity is shaped to receive the protrusion such that rotation of the first body relative to the second body is blocked. The method further includes inserting a distal portion of a second fastener into a third cavity defined by the first fastener, thereby capturing the second body between the distal portion and a proximal portion of the second fastener. The distal portion is opposite the proximal portion with respect to the first direction.

According to one aspect of the disclosure a moment frame includes a first vertical structural member including a first inner column elongate along a first direction and a first outer column elongate along the first direction, the first inner column spaced from the first outer column by a first gap with respect to a second direction that is perpendicular to the first direction. The moment frame further includes a second vertical structural member including a second inner column elongate along the first direction and a second outer column elongate along the first direction, the second inner column spaced from the second outer column by a second gap with respect to the second direction. The moment frame further includes a horizontal structural member rigidly connected to both the first vertical structural member and the second vertical structural member such that the horizontal structural member is elongate along the second direction.

According to one aspect of the disclosure a method of assembling a modular structure includes rigidly connecting a first pair of vertical structural members to a first pair of the horizontal structural members thereby forming a first moment frame. The method further includes rigidly connecting a second pair of vertical structural members to a second pair of horizontal structural members thereby forming a second moment frame. The method further includes connecting the first moment frame to the second moment frame such that the first pair of horizontal structural members are perpendicular to the second pair of horizontal structural members.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1:
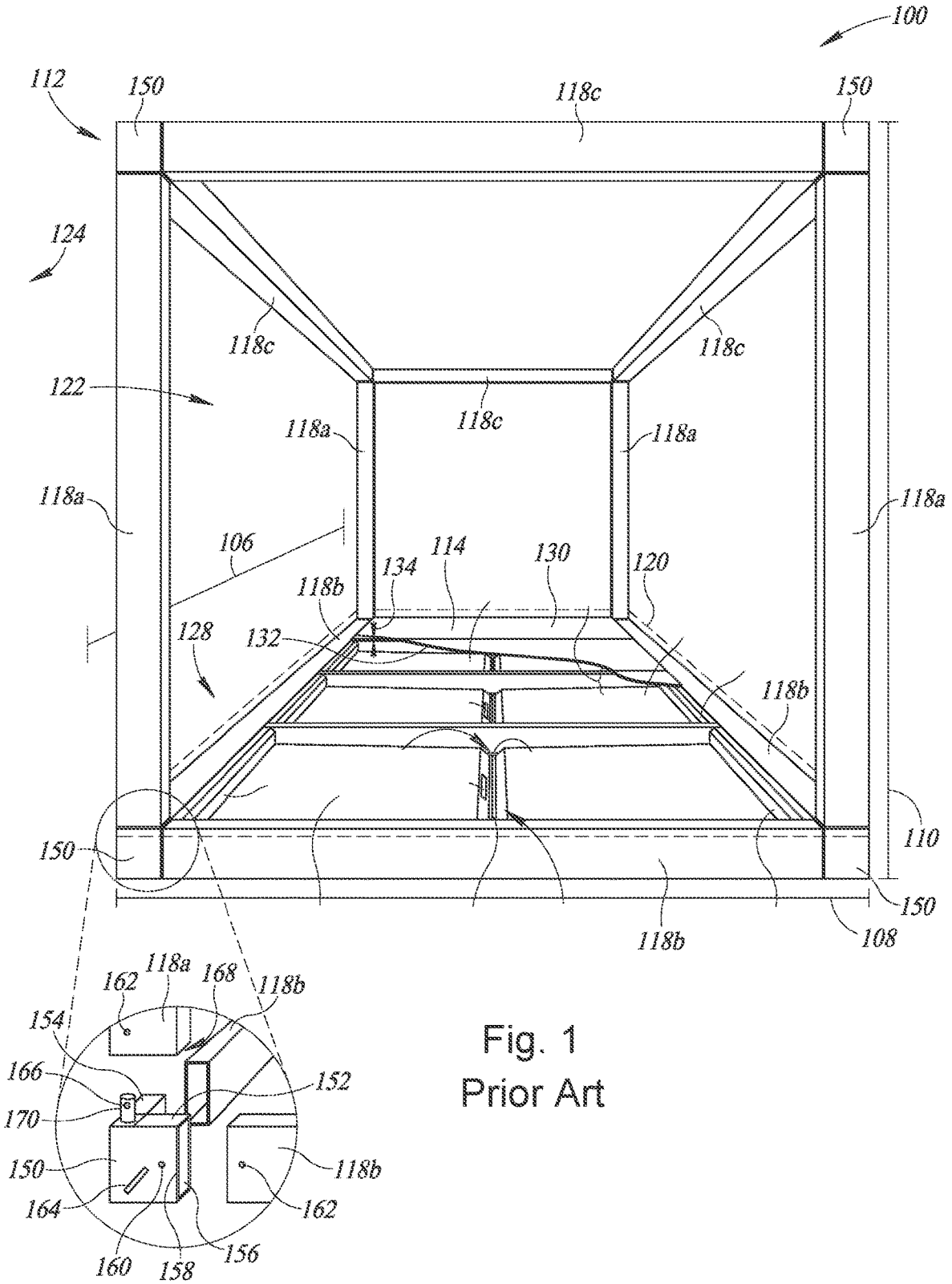
Fig. 1 Prior Art
FIG. 1 is a front, perspective view of a known modular structure.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with connectors used in the construction of modular structures have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment," "an embodiment," or "an aspect of the disclosure" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

Reference herein to two elements "facing" or "facing toward" each other indicates that a straight line can be drawn from one of the elements to the other of the elements without contacting an intervening solid structure. Reference herein to two elements being "directly coupled" indicates that the two elements physically touch with no intervening structure between. Reference herein to a direction includes both vectors that make up said direction. For example a vertical direction includes both an "up" vector and a "down" vector, which is opposite the "up" vector. Reference to an element extending along a direction means the element extends along one or both of the vectors that make up the direction.

The term "aligned" as used herein in reference to two elements along a direction means a straight line that passes through one of the elements and that is parallel to the direction will also pass through the other of the two elements. The term "between" as used herein in reference to a first element being between a second element and a third element with respect to a direction means that the first element is closer to the second element as measured along the direction than the third element is to the second element as measured along the direction. The term "between" includes, but does not require that the first, second, and third elements be aligned along the direction.

Recitation of ranges of values herein are merely intended to serve as a shorthand method of referring individually to each separate value falling within the range including the stated ends of the range, unless otherwise indicated herein, and each separate value is incorporated into the specification as if it were individually recited herein.

Aspects of the disclosure will now be described in detail with reference to the drawings, wherein like reference numbers refer to like elements throughout, unless specified otherwise. Certain terminology is used in the following description for convenience only and is not limiting. The term "plurality", as used herein, means more than one. The terms "a portion" and "at least a portion" of a structure include the entirety of the structure.

The headings and Abstract of the Disclosure provided herein are for convenience only and do not interpret the scope or meaning of the embodiments.

Figure 2:
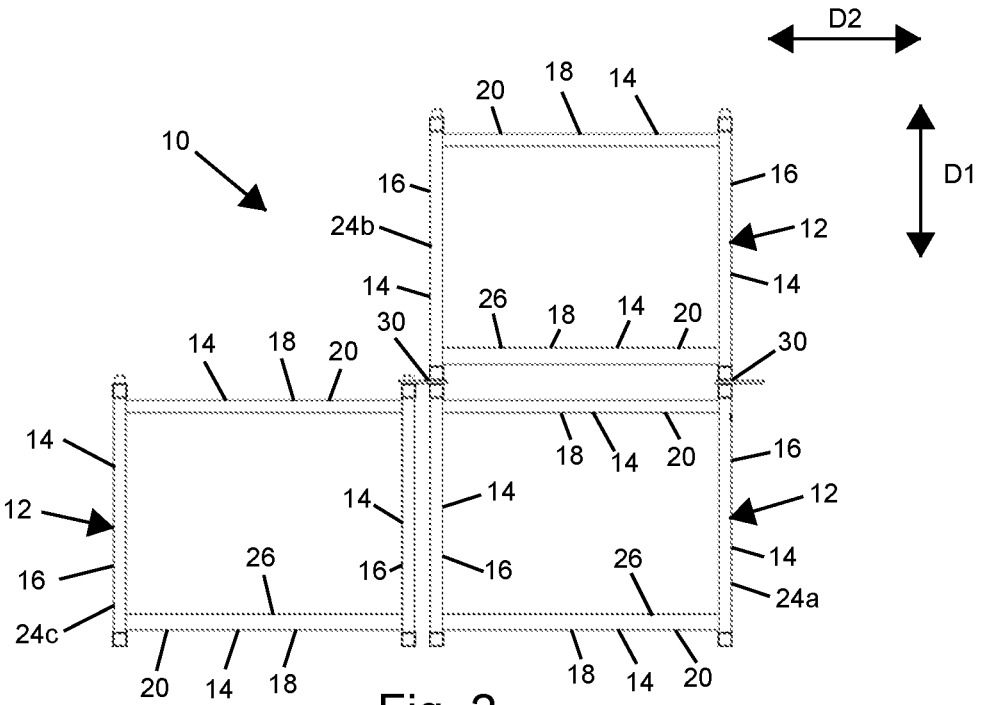
FIG. 2 is a front elevation view of a modular structure according to one embodiment.
Figure 3:
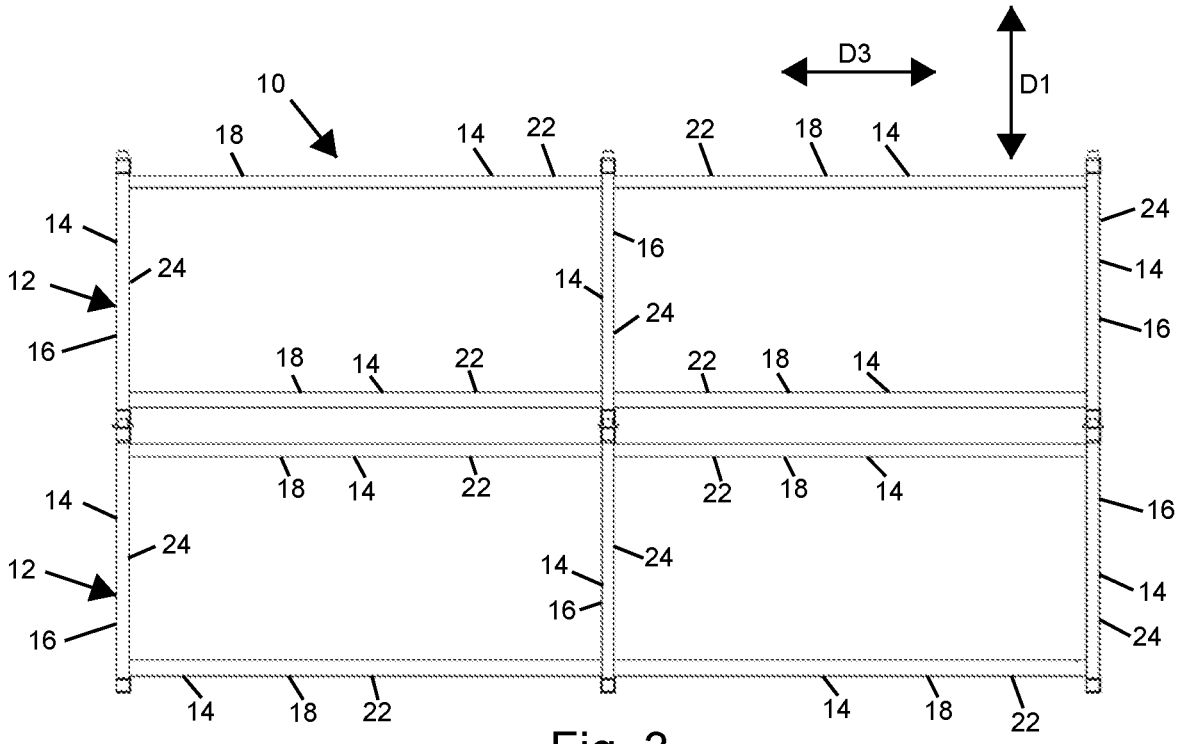
FIG. 3 is a side elevation view of the modular structure illustrated in FIG. 2.
Figure 4:
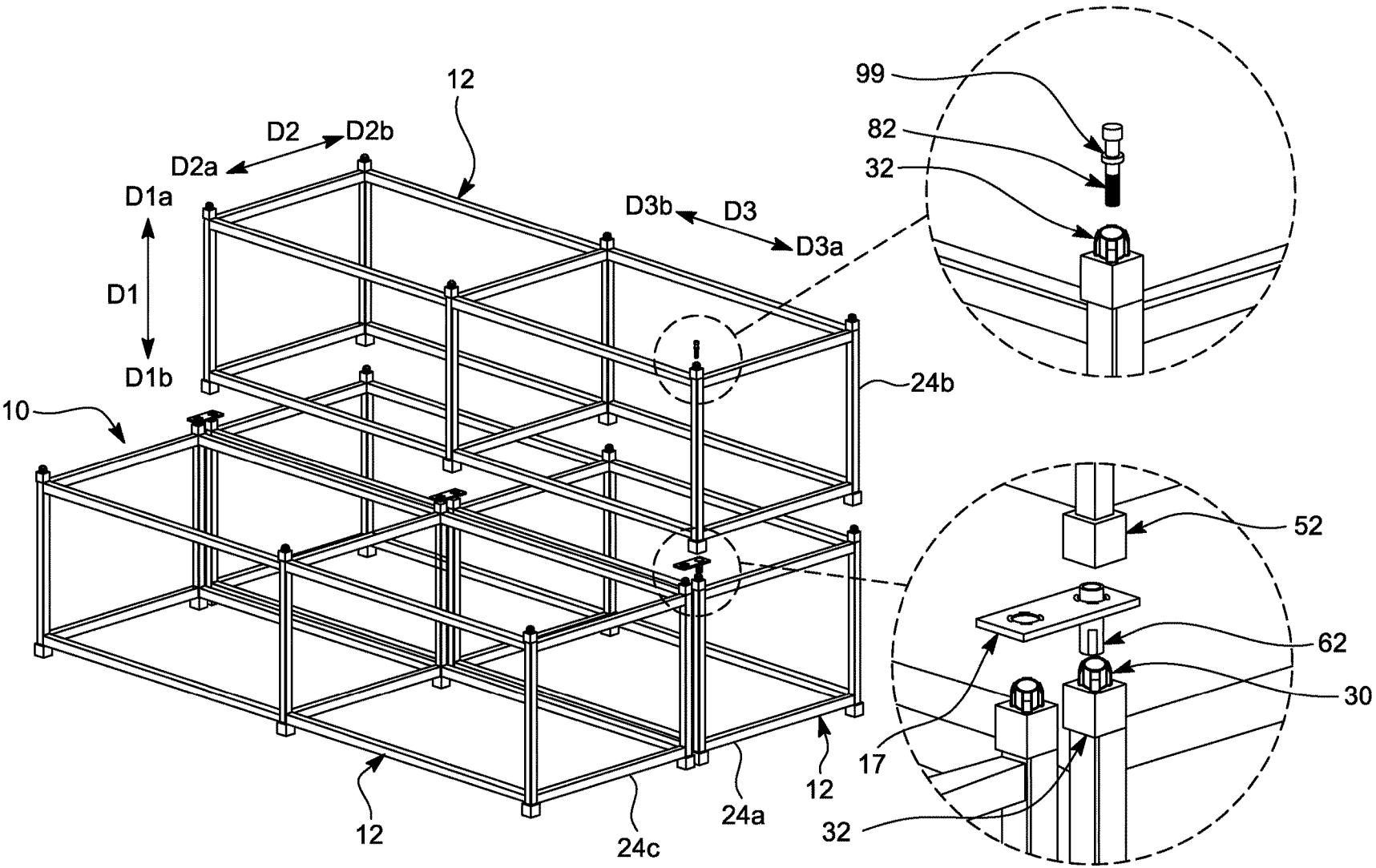
FIG. 4 is an isometric view of the modular structure illustrated in FIG. 2, the modular structure including a connector, according to one embodiment.
Figure 7:
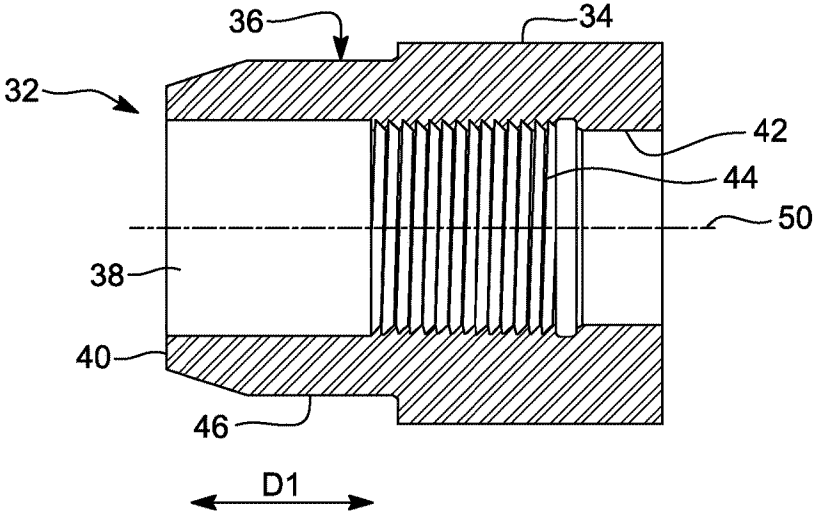
FIG. 7 is a cross-sectional view of the first body illustrated in FIG. 6, along line A-A.
Figure 8:
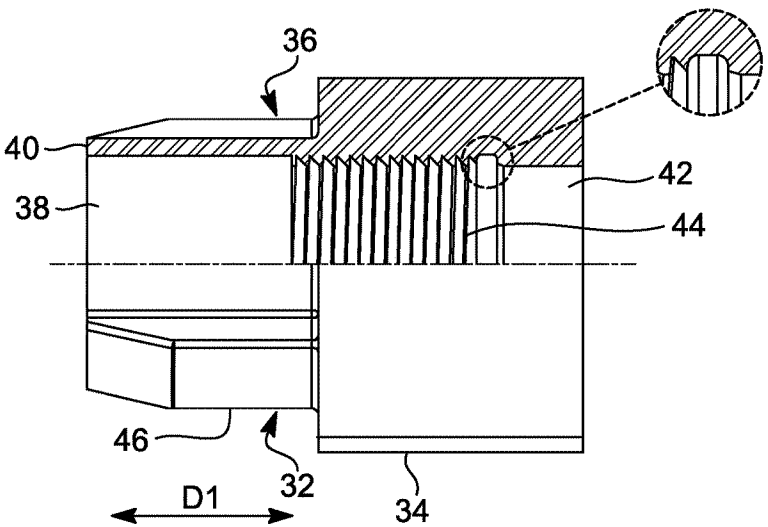
FIG. 8 is a front, elevation view, with partial cross-section of the first body illustrated in FIG. 6.
Figure 5:
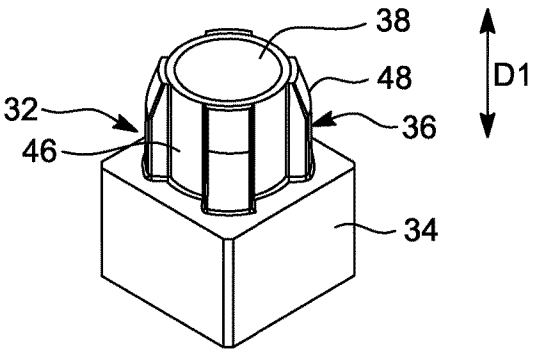
FIG. 5 is an isometric view of a first body of the connector illustrated in FIG. 4, according to one embodiment.
Figure 6:
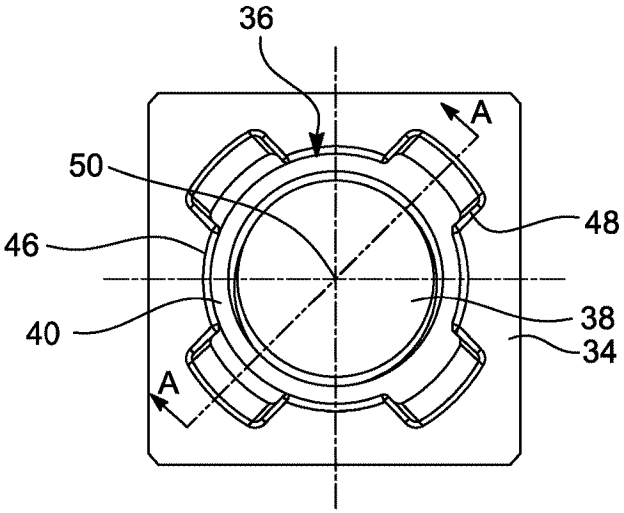
FIG. 6 is a top plan view of the first body illustrated in FIG. 5.

Referring to FIGS. 2 to 4, a modular structure 10 may include one or more structural blocks 12. Each of the structural blocks 12 may define an outer perimeter for at least a portion of the modular structure 10. As shown in the illustrated embodiment, each of the structural blocks 12 may define a three dimensional shape, for example a rectangular prism, a cube, or a cuboid. The structural block 12 includes a plurality of structural members 14. The plurality of structural members 14 may include vertical structural members 16 and horizontal structural members 18. According to one aspect of the disclosure, at least some of the plurality of structural members 14 may be tubular members.

The vertical structural members 16 may be arranged such that the vertical structural members 16 are elongate along a first direction D1, for example a vertical direction. The horizontal structural members 18 may include lateral structural members 20 and longitudinal structural members 22. The lateral structural members 20 are elongate along a second direction D2. As shown the second direction D2 may be perpendicular to the first direction D1. The longitudinal structural members 22 are elongate along a third direction D3. As shown the third direction D2 may be perpendicular to at least one of, for example both, the first direction D1 and the second direction D2.

The modular structure 10 may include the plurality of structural members 14 with different lengths. For example, the length of the vertical structural members 16 as measured along the first direction D1 may be different than the length of one or both of the lateral structural members 20 as measured along the second direction D2 and the longitudinal structural members 22 as measured along the third direction D3. According to another embodiment, the length of the vertical structural members 16 as measured along the first direction D1 may be the same as the length of one or both of the lateral structural members 20 as measured along the second direction D2 and the longitudinal structural members 22 as measured along the third direction D3.

The structural blocks 12 may be described as including a number, for example 2 or more, moment frames 24. Each of the moment frames 24 may include two or more moment connections. According to one embodiment, a moment connection is a joint that allows the transfer of bending moment forces between two members, such as a column and a beam. Members of the moment frame 24 are rigidly connected, for example by welding, so as to resist bending moments and shear forces applied to the modular structure 10.

The moment frames 24, as shown, may include two of the vertical structural members 16 each coupled to two of the horizontal structural members 18 by a moment connection. Thus, according to one embodiment, the moment frame 24 may include four moment connections. It will be appreciated by those of skill in the art that the moment frame 24 may include other numbers of members and moment connections. For example, the moment frame 24 may be in the form of a goalpost having two of the vertical structural members 16 and one of the horizontal structural members 18 and two moment connections joining the horizontal structural member 18 to both of the vertical structural members 16.

According to one embodiment, the structural block 12 may include a series of moment frames 24 that each include a pair of the vertical structural members 16 and a pair of the lateral structural members 20 connecting the pair of the vertical structural members 16. Adjacent ones of the series of moment frames 24 may be connected by a plurality, for example four, of the longitudinal structural members 22. According to one embodiment, the longitudinal structural members 22 connecting adjacent ones of the moment frames 24 may be non-rigidly connected, for example by friction fit or protrusion and recess, to the adjacent moment frames 24.

As shown, the moment frame 24 may be in the form of a closed shape, such as a square tube 26, that includes two vertical structural members 16, and two horizontal structural members 18, for example two lateral structural members 20, each coupled to both of the two vertical structural members 16. According to one embodiment the modular structure 10 may include a plurality of the moment frames 24. As shown in FIG. 2, the plurality of moment frames 24 may include a first moment frame 24*a*, a second moment frame 24*b*, and a third moment frame 24*c*. The first moment frame 24*a* may be positioned adjacent the second moment frame 24*b* with respect to the first direction D1, and the first moment frame 24*a* may be positioned adjacent the third moment frame 24*c* with respect to the second direction D2.

The modular structure 10 may include a connector 30 to attach and secure a plurality of the structural blocks 12 to one another. According to one aspect of the disclosure, the connector 30 may attach one of the vertical structural members 16 of the first moment frame 24*a* to one of the vertical structural members 16 of the second moment frame 24*b*. According to one aspect of the disclosure, the connector 30 may attach one of the vertical structural members 16 of the first moment frame 24*a* to one of the vertical structural members of the third moment frame 24*c*. According to one aspect of the disclosure, the connector 30 may attach one of the vertical structural members 16 of the first moment frame 24*a* to both one of the vertical structural members of the second moment frame 24*b* and one of the vertical structural members 16 of the third moment frame 24*c*.

According to one aspect of the disclosure, the connector 30 may attach vertical structural members from adjacent ones of the structural blocks 12. According to another aspect of the disclosure, the connector 30 may attach any two adjacent members that may not form a portion of the modular structure 10. For example, the connector 30 may be used to couple two adjacent tubular members that are part of a vehicle.

Referring to FIGS. 4 to 9, the connector 30 may include a first body 32 having a base portion 34 and a protrusion 36. The protrusion 36 extends away from the base portion 34 along a direction, for example along the first direction D1. As shown in the illustrated embodiment, the protrusion 36 may extend away from the base portion 34 in a first vector D1*a* of the first direction D1.

According to one aspect of the disclosure the first direction D1 may include two vectors, the first vector D1*a* and a second vector D1*b* opposite one another. As shown, the first direction D1 may include a vertical direction (perpendicular to the ground), the first vector D1*a* is "up," and the second vector D1*b* is "down." According to one aspect of the disclosure the second direction D2 may include two vectors, a first vector D2*a* and a second vector D2*b* opposite one another. According to one aspect of the disclosure the third direction D3 may include two vectors, a first vector D3*a* and a second vector D3*b* opposite one another.

The first body 32 may define a first cavity 38 that extends into the protrusion 36 and towards the base portion 34 along the first direction D1, for example in the second vector of the first direction D1*b*. As shown, the protrusion 36 include a distal tip 40 positioned such that the protrusion 36 extends away from the base portion 34 and terminates at the distal tip 40. According to one aspect of the disclosure, the first cavity 38 may extend through an entirety of the first body 32 with respect to the first direction D1. According to another embodiment, the first cavity 38 may terminate within the first body 32, for example within the protrusion 36 or within the base portion 34. The threads 244 may be located within the protrusion 236, the base portion 234, or both the protrusion 236 and the base portion 234.

As shown in the illustrated embodiment, the first body 32 may include an inner surface 42 that at least partially has the first cavity 38. At least a portion of the inner surface 42 may define threads 44.

The protrusion 36 may include an outer surface 46, which has a non-circular cross-sectional shape within a plane normal to the first direction D1. As shown, the protrusion 36 may include one or more tabs 48 that extend radially outward away from a central axis 50 of the first cavity 38.

The base portion 34 may be attachable to one or more of the plurality of structural members 14. As shown in the illustrated embodiment, the base portion 34 may be directly coupleable to one of the vertical structural members 16. The base portion 34 may be directly coupleable to the vertical structural member 16 by welding, press fit (for example by inserting a portion of the vertical structural member 16 into a portion of the first cavity 38), adhesive, thermal expansion, mechanical fastener, or any other known attachment method or mechanism.

One or more horizontal structural members 18, for example one or more lateral structural members 20 and one or more longitudinal structural members 22, may be coupled directly to the vertical structural member.

Referring to FIGS. 2 and 9 to 12, the connector 30 may include an alternative embodiment of a first member 232. The first member 232 is similar to the first body 32 such that any description or the structure and use of the first body 32 is also applicable to the first member 232, and vice versa, except where indicated to the contrary herein. Like elements of the first body 32 are increased by 200 in reference to the member 232, and description of an element of the first body 32 is applicable to the like element of the first member 232. Likewise, the first member 232 and its like elements can be substituted for the first body 32 and the corresponding like elements within this disclosure.

The first body 232 includes a base portion 234 and a protrusion 236. The protrusion 236 extends away from the base portion 234 along a direction, for example along the first direction D1. As shown in the illustrated embodiment, the protrusion 236 may extend away from the base portion 234 in a first vector D1*a* of the first direction D1.

The first body 232 may define a first cavity 238 that extends into a protrusion 236 and towards a base portion 234 along the first direction D1, for example in the second vector of the first direction D1*b*. As shown, the protrusion 236 may include a distal tip 240 positioned such that the protrusion 236 extends away from the base portion 234 and terminates at the distal tip 240. According to one aspect of the disclosure, the first cavity 238 may extend through an entirety of the first body 232 with respect to the first direction D1. According to another embodiment, the first cavity 238 may terminate within the first body 232, for example within the protrusion 236 or within the base portion 234.

As shown in the illustrated embodiment, the first body 232 may include an inner surface 242 that at least partially establishes a boundary of the first cavity 238. At least a portion of the inner surface 242 may define threads 244. The threads 244 may be located within the protrusion 236, the base portion 234, or both the protrusion 236 and the base portion 234.

The protrusion 236 may include an outer surface 246, which has a non-circular cross-sectional shape within a plane normal to the first direction D1. As shown, the protrusion 236 may include one or more tabs 248 that extend radially outward away from a central axis 250 of the first cavity 238.

The base portion 234 may be attachable to one or more of the plurality of structural members 14. As shown in the illustrated embodiment, the base portion 234 may be directly coupleable to one of the vertical structural members 16. The base portion 234 may be directly coupleable to the vertical structural member 16 by welding, press fit (for example by inserting a portion of the vertical structural member 16 into a portion of the first cavity 238), adhesive, thermal expansion, mechanical fastener, or any other known attachment method or mechanism. To accommodate insertion of the vertical structural member 16 into the first cavity 238, a cross-sectional dimension, measured perpendicular to the first direction D1, of the first cavity 238 in the base portion 234 may be larger than a cross-sectional dimension, measured perpendicular to the first direction D1, of the first cavity in the protrusion 236.

Figure 9:
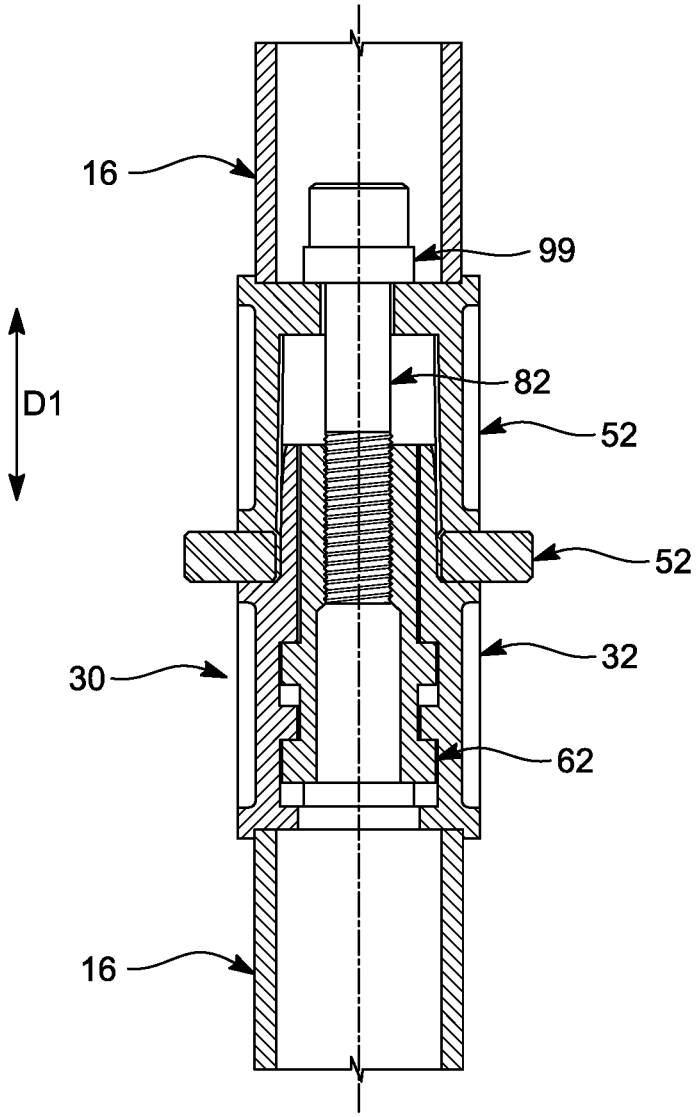
FIG. 9 is a cross-sectional view of the connector illustrated in FIG. 4, according to one embodiment.
Figure 10:
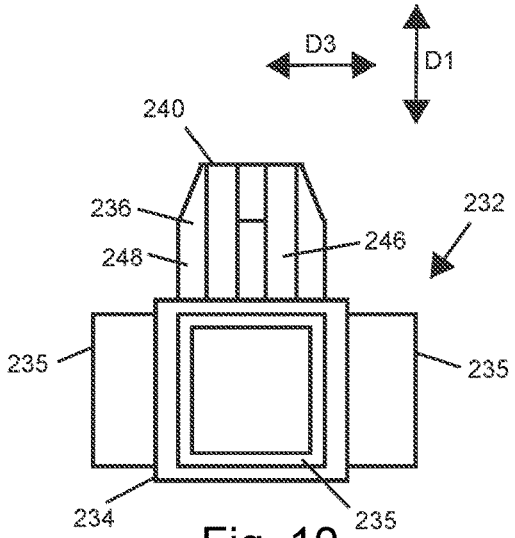
FIG. 10 is a front, elevation view of a first body of the connector illustrated in FIG. 4, according to another embodiment.
Figure 11:
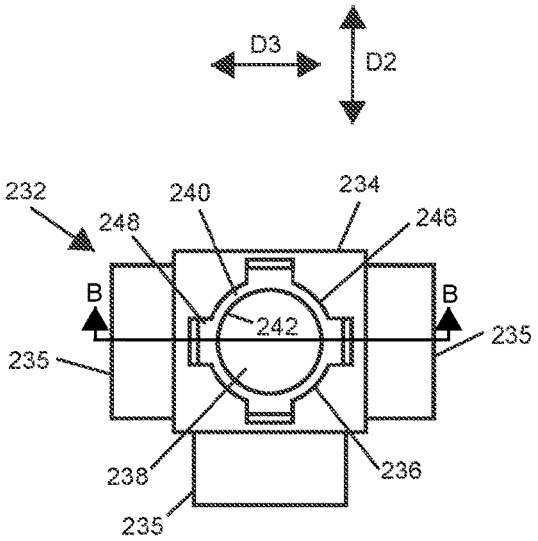
FIG. 11 is a top, plan view of the first body illustrated in FIG. 10.
Figure 12:
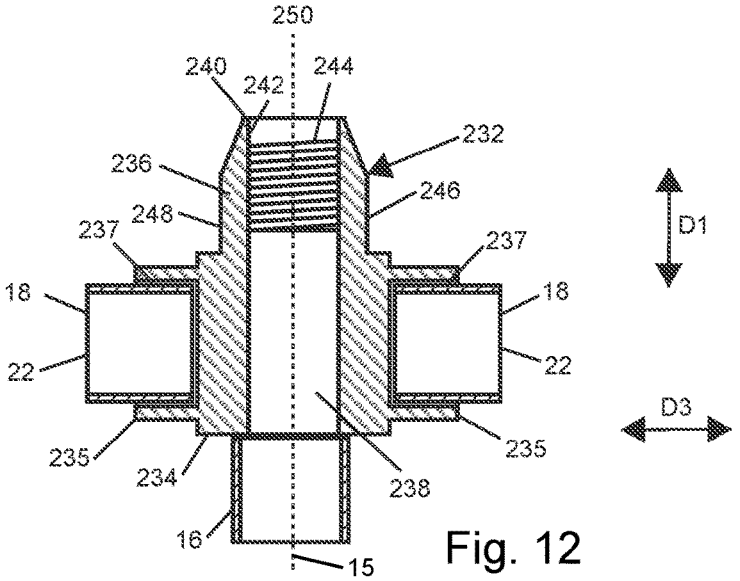
FIG. 12 is a cross-sectional view of the first body illustrated in FIG. 11, along line B-B.
Figure 13:
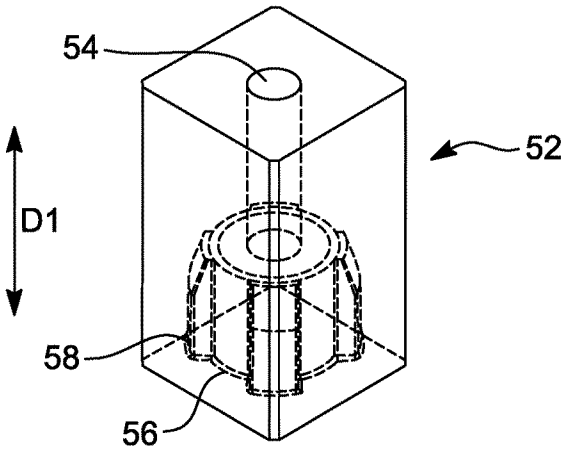
FIG. 13 is an isometric view of a second body of the connector illustrated in FIG. 4, according to one embodiment.
Figure 14:
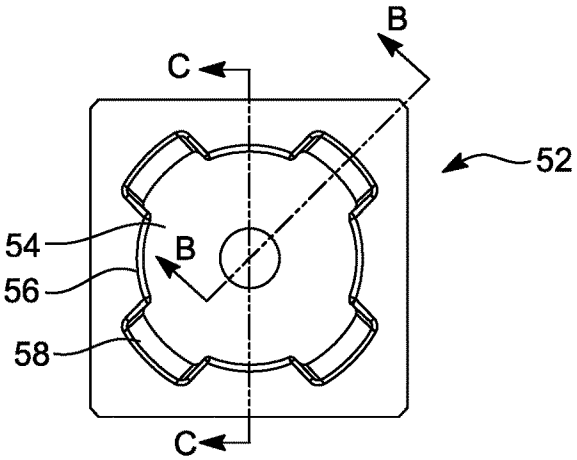
FIG. 14 is a top, plan view of the second body illustrated in FIG. 13.
Figure 15:
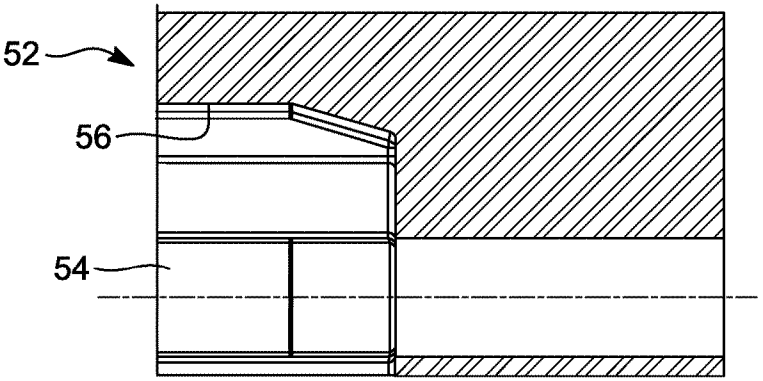
FIG. 15 is a cross-sectional view of a portion of the second body illustrated in FIG. 14, along line B-B.
Figure 16:
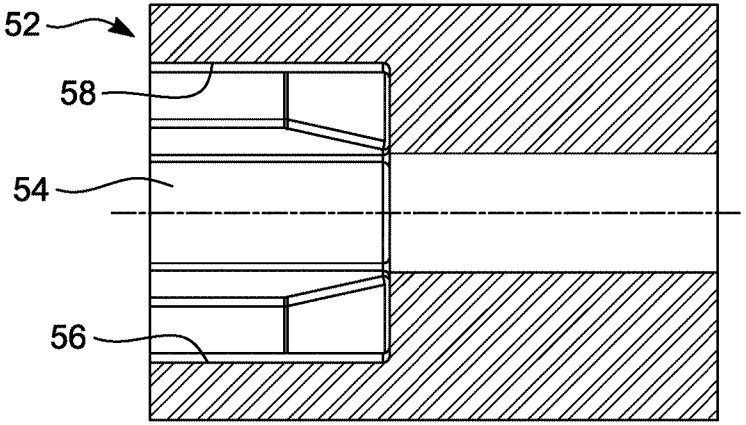
FIG. 16 is a cross-sectional view of the second body illustrated in FIG. 14, along line C-C.

According to one aspect of the disclosure, the base portion 34, 234 may be adjustably coupleable to the vertical structural member 16. For example, the base portion 34, 234 may be coupleable to the vertical structural member 16 in a plurality of relative positions along the first direction D1, the second direction D2, the third direction D3, or any combination thereof. Thus, according to one embodiment, the first body 32, 232 is coupleable to the vertical structural member 16 such that the central axis 50, 250 of the first body 32, 232 is collinear with a central axis 15 of the vertical structural member 16 (as shown in FIG. 9). According to one embodiment, the first body 32, 232 is coupleable to the vertical structural member 16 such that the central axis 50, 250 of the first body 32, 232 is offset with respect to the central axis 15 in the second direction D2, the third direction D3, or both the second direction D2 and the third direction D3.

The adjustability may result in a more efficient assembly process, as errors in the alignment of the plurality of structural members 14 may be compensated by adjusting the relative position of the first body 32, 232 and the vertical structural member 16 to which the base portion 34, 234 is secured. According to one embodiment, the base portion 34, 234 may define an oversized hole that is larger than the vertical structural member 16. Washers, shims, fasteners, welding, etc. may be used to adjust the relative position of the vertical structural member 16 within the oversized hole and secure the vertical structural member 16 within the oversized hole at the desired position.

The first body 232 may include one or more sleeves 235 that extend out and away from the base portion 234. The one or more sleeves 235 may extend in a direction perpendicular to the first direction D1. According to one embodiment, the sleeve 235 may define an enclosed shape, for example a shape that corresponds to a shape of the horizontal structural members 18. According to one embodiment, the sleeve 235 may define an open shape, for example the sleeve 235 may include a top plate and a bottom plate spaced along the first direction D1 by a gap sized to receive one of the horizontal structural members 18. According to one aspect of the disclosure, the first body 232 may include at least one sleeve 235 that extends in the second direction D2, and at least one sleeve 235 that extends in the third direction D3. As shown in the illustrated embodiment, the first body 232 may include one sleeve 235 that extends away from the base portion 234 along the second direction D2, and two sleeves 235 that extend away from the base portion 234, and away from each other, along opposite vectors of the third direction D3.

According to one embodiment, a kit may include the connector 30 including one or more of the first body 32, one or more of the first body 232, or both. The kit may include one of the first body 232 with a number of the sleeves 235 (for example two), and one of the first body 232 with a different number of sleeves 235 (for example three). According to one embodiment, a kit may include a plurality of the connectors 30 including one or more of the connectors 30 with the first body 32, one or more of the first body 232, or both. The kit may include one of the first body 232 with a number of the sleeves 235 (for example two), and one of the first body 232 with a different number of sleeves 235 (for example three).

The sleeves 235 may each define a respective cavity 237 that corresponds to the horizontal structural members 18 such that the first body 232 is directly coupleable to one or more of the horizontal structural members 18, for example one or more lateral structural members 20 and one or more longitudinal structural members 22. The first body 232 may be directly coupleable to the one or more horizontal structural members 18 by welding, press fit, adhesive, thermal expansion, mechanical fastener, or any other known attachment method or mechanism.

According to another embodiment, the first body 232 may include one or more protrusions in place of one or more of the sleeves 235, such that the protrusions are receivable within an inner cavity of the one or more horizontal structural members 18 to directly couple the first body 232 and the one or more horizontal structural members 18.

Referring to FIGS. 9 and 13 to 16, the connector 30 may include a second body 52. As shown, the second body 52 may be separate and discrete from the first body 32. The second body 52 may define a second cavity 54 that is sized and shaped to receive at least a portion of the protrusion 36. The second body 52 may include an inner surface 56, which establishes a boundary of the second cavity 54. The inner surface 56 may have a non-circular cross-sectional shape within a plane normal to the first direction D1 enabling the second cavity to receive the protrusion 36 such that rotation of the first body 32 relative to the second body 52 is blocked, for example limited or prevented.

According to one embodiment, the second cavity 54 may include recesses 58 that align with the tabs 48 of the protrusion 36 such that rotation of one of the first body 32 and the second body 52 relative to the other about the first direction D1 is blocked by interference of the tabs 48 and the recess 58.

Referring to FIGS. 9 and 17 to 20, the connector 30 may include a first fastener 62. The first fastener 62 may include an outer surface 64 and an inner surface 66. The inner surface 66, as shown, may define a third cavity 68. The first fastener 62 may be sized and shaped to be receivable within the first cavity 38. The outer surface 64 may include threads 70 that correspond to (threadedly mate with), the threads 44 of the first body 32. At least a portion of the inner surface 66 may include threads 72. The threads 72 may be a different pitch than the threads 70. Alternatively, the threads 72 may be the same pitch as the threads 70.

Figure 18:
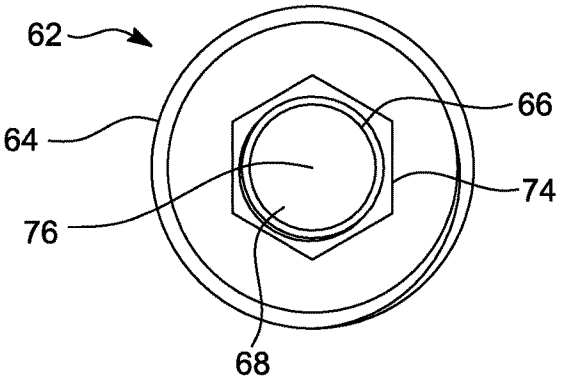
FIG. 18 is a top, plan view of the first fastener illustrated in FIG. 17.
Figure 20:
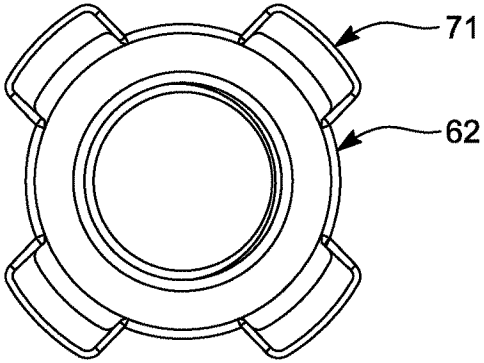
FIG. 20 is a top, plan view of the first fastener illustrated in FIG. 19.
Figure 17:
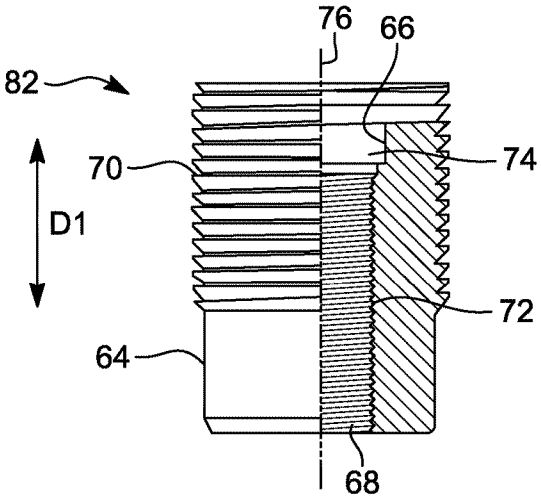
FIG. 17 is a front, elevation view, with partial cross-section of a first fastener of the connector illustrated in FIG. 4, according to one embodiment.
Figure 19:
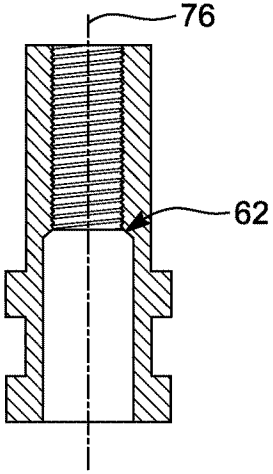
FIG. 19 is a cross-sectional view of a first fastener of the connector illustrated in FIG. 4, according to one embodiment.
Figure 21:
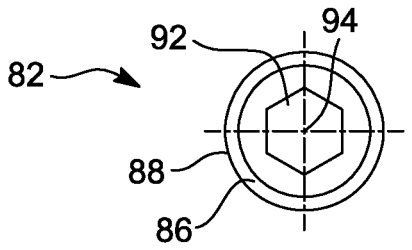
FIG. 21 is a top, plan view of a second fastener of the connector illustrated in FIG. 4, according to one embodiment.
Figure 22:
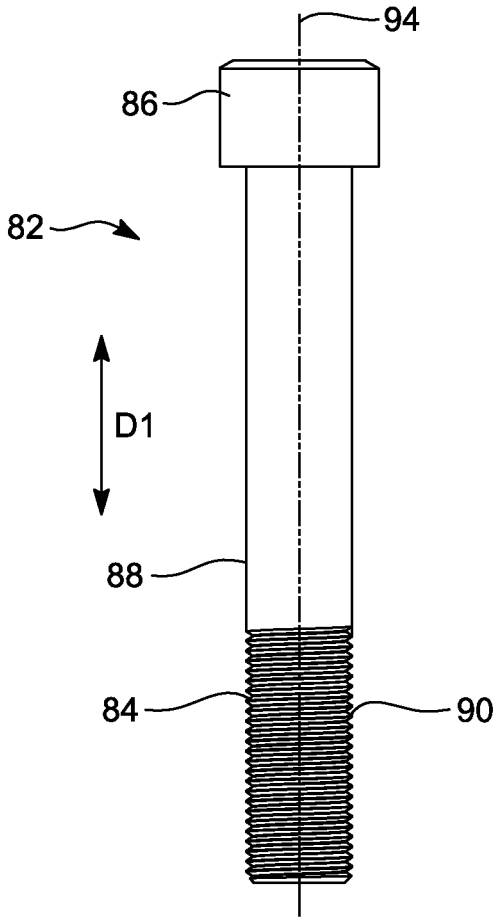
FIG. 22 is a front, elevation view of the second fastener illustrated in FIG. 21.
Figure 23:
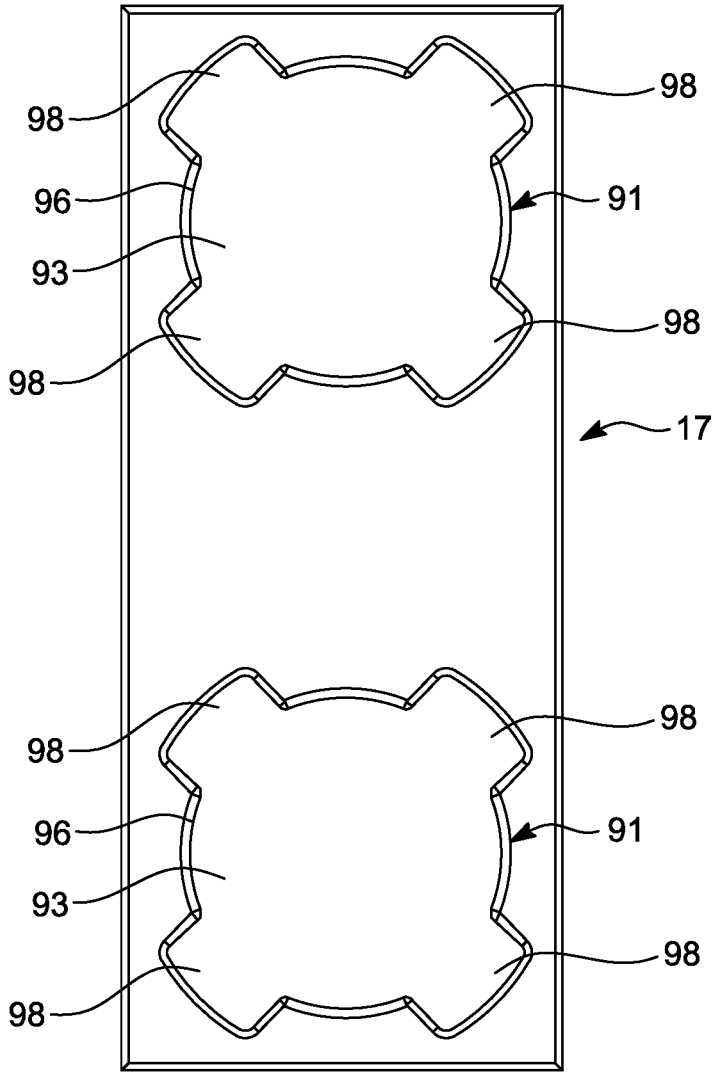
FIG. 23 is a top, plan view of a third body of the connector illustrated in FIG. 4, according to one embodiment.
Figure 24:
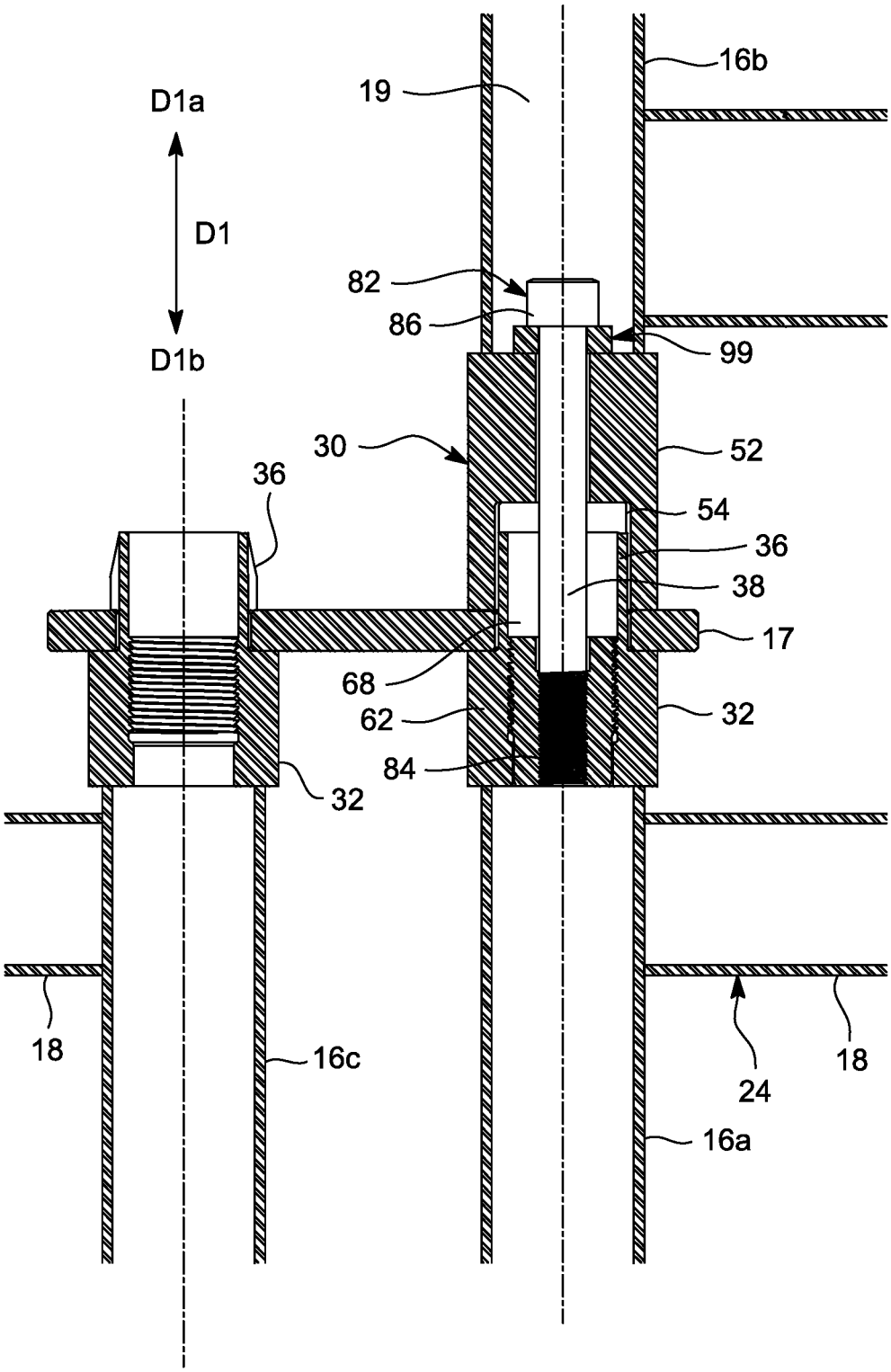
FIG. 24 is a cross-sectional view of a portion of the modular structure illustrated in FIG. 4, including the connector, according to one embodiment.

As shown in FIGS. 17 and 18, the first fastener 62 may be securable within the first cavity 38 such that translation of the first fastener 62 relative to the first body 32 along the first direction D1 is blocked, for example by interference of the threads 44 and the threads 70. The first fastener 62 may include a drive input 74 that receives an input, for example a torque, which rotates the first fastener 62 about a central axis 76 of the first fastener 62, thereby engaging the threads 44 and the threads 70 and securing the first fastener 62 relative to the first body 32. According to one embodiment, the drive input 74 may include a portion of the third cavity 68 with a non-circular shape. As shown in FIGS. 19 and 20, the first fastener 62 may include one or more protrusions 71 that correspond to recesses within the first body 32, or vice versa, that engage to secure the first fastener 62 relative to the first body 32.

Referring to FIGS. 2 and 17 to 22, the connector 30 may include a second fastener 82. The second fastener 82, as shown, may include a distal portion 84 and a proximal portion 86. The second fastener 82 may include an outer surface 88, which includes threads 90 that correspond to the threads 72 of the inner surface 66 of the first fastener. The second fastener 82 may be securable within the third cavity 68 such that translation of the second fastener 82 relative to the first fastener 62 along the first direction D1 is blocked, for example by interference of the threads 90 and the threads 72.

The proximal portion 86 may include a drive input 92 that receives an input, for example a torque, which rotates the second fastener 82 about a central axis 94 of the second fastener 82, thereby engaging the threads 90 and the threads 72 and securing the second fastener 82 relative to the first fastener 62. According to one embodiment, the proximal portion 86 has a cross-sectional dimension greater than a cross-sectional dimension of the distal portion 84.

Referring to FIGS. 4 to 9 and 23, the connector 30 may include a third body 17. The third body 17 may include a plurality of cavities 91 that each are sized and shaped to secure the third body 17 to respective ones of the first bodies 32 and/or the second bodies 52. As shown in the illustrated embodiment, the plurality of cavities 91 may be in the form of through holes 93 each defined by an inner surface 96 of the third body 17.

The through holes 93 may be sized and shaped to engage with corresponding features on one or both of the first body 32 and the second body 52. According to one aspect of the disclosure, the through holes 93 may be sized and shaped to attach the third body 17 to the first body 32 and/or the second body 52 such that rotation of the third body 17 relative to the first body 32 and/or the second body 52 is blocked. The plurality of through holes may define an enclosed shape, for example an enclosed shape that corresponds to the cross-sectional shape of the protrusion 36. For example, the through holes 93 may include recesses 98 that align with and receive the tabs 48 when the protrusion 36 is inserted into the through hole 93.

According to one aspect of the disclosure, each of the plurality of cavities 91 may be identical. Alternatively, one or more of the plurality of cavities 91 may be different in size, shape, or orientation with respect to another of the plurality of cavities 91.

Referring to FIGS. 2 to 24, a method of constructing a modular structure 10 may include coupling the first body 32 to one of the plurality of vertical structural members 16. The method may include inserting the first fastener 62 into the first cavity 38. According to one embodiment, inserting the first fastener 62 into the first cavity 38 includes moving the first fastener 62 relative to the first body 32 in the second vector of the first direction D1*b*.

The method may further include inserting the protrusion 36 into the second cavity 54 defined by the second body 52 such that rotation of the first body 32 relative to the second body 52 is blocked. The method may include inserting the distal portion 84 of the second fastener 82 into the third cavity 68 defined by the first fastener 62, thereby capturing the second body 52 between the distal portion 84 and the proximal portion 86 of the second fastener 82.

Moving the first fastener 62 relative to the first body 32 in the second vector of the first direction D1*b* may include rotating the first fastener 62 about the first fastener central axis 76, which is parallel to the first direction D1, thereby engaging the first outer threads 70 defined by the outer surface 64 of the first fastener 62 with the corresponding first inner threads 44 defined by the inner surface 42 of the first body 32. Inserting the distal portion 84 of the second fastener 82 into the third cavity 68 may include rotating the second fastener 82 about the second fastener central axis 94, which may be parallel to the first direction D1, thereby engaging the second inner threads 72 with the corresponding second outer threads 90.

According to one aspect of the disclosure, capturing the second body 52 includes capturing at least a portion of the second body 52 between the base portion 34 of the first body 32 and the proximal portion 86 of the second fastener 82 with respect to the first direction D1. The connector 30 may include a collar 99 that the distal portion 84 passes through, such that the collar 99 is captured between the proximal portion 86 and the second body 52.

The method may further include attaching the first body 32 to a first vertical structural member 16*a*, attaching the second body 52 to a second vertical structural member 16*b*, inserting a tool through an interior cavity 19 defined by the second vertical structural member 16*b* until the tool engages the proximal portion 86 of the second fastener 82, and rotating the tool, thereby rotating the second fastener 82, and thereby inserting the distal portion 84 of the second fastener 82 into the third cavity 68.

The method may include attaching the first vertical structural member 16*a* to the second vertical structural member 16*b*, which is aligned with the first vertical structural member 16*a* along the first direction D1. The method may include attaching the first vertical structural member 16*a* to the third vertical structural member 16*c*, which is offset with the first vertical structural member 16*a* along the first direction D1.

The method may include attaching the first body 232 to a first horizontal structural member 18 by inserting a portion of the first horizontal structural member 18 into the cavity 237 defined by one of the sleeves 235. The method may include inserting a second portion of the first horizontal structural member 18 into the cavity 237 defined by the first body 232 of another connector 30.

The method may include attaching the first body 232 to a second horizontal structural member 18. According to one aspect of the disclosure, attaching the first body 32 to the second horizontal structural member 18 may include inserting a portion of the second horizontal structural member 18 into the cavity 237 defined by the sleeve 235 of the first body 232.

Prior to inserting the protrusion 36 into the second cavity 54, the method may include inserting the protrusion 36 through one of the plurality of through holes 91 of the third body 17. The method may include inserting the protrusion 36 of another of the plurality of first bodies 32 through another of the plurality of through holes 91 of the third body 17, thereby fixing a position of the one of the plurality of first bodies 32 relative to the other of the plurality of first bodies 32.

A method of assembling the connector 30 may include inserting the first fastener 62 into the first cavity 38, inserting the protrusion 36 into the second cavity 54 defined by the second body 52, inserting the distal portion 84 of the second fastener 82 into the third cavity 68 defined by the first fastener 62, thereby capturing the second body 52 between the distal portion 84 and the proximal portion 86 of the second fastener 82.

Inserting the first fastener 62 into the first cavity 38 may include moving the first fastener 62 relative to the first body 32 in the second vector of the first direction D1*b*. Moving the first fastener 62 relative to the first body 32 may include rotating the first fastener 62 about the first fastener central axis 76, thereby engaging the first outer threads 70 defined by the outer surface 64 of the first fastener 62 with the corresponding first inner threads 44 defined by the inner surface 38 of the first body 32.

Inserting the distal portion 84 of the second fastener 82 into the third cavity 68 may include rotating the second fastener 82 about the second fastener central axis 94, which is parallel to the first direction D1, thereby engaging the second inner threads 72 with the corresponding second outer threads 90.

Figure 25:
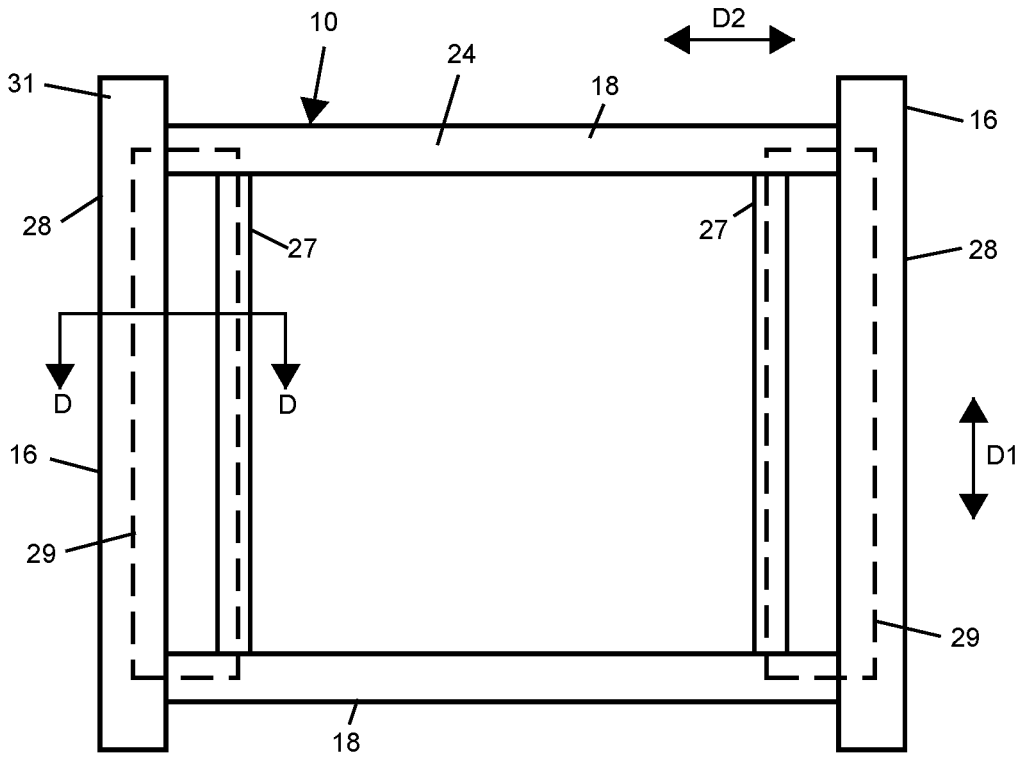
FIG. 25 is a front, elevation view of a moment frame of a modular structure according to one embodiment.
Figure 26:
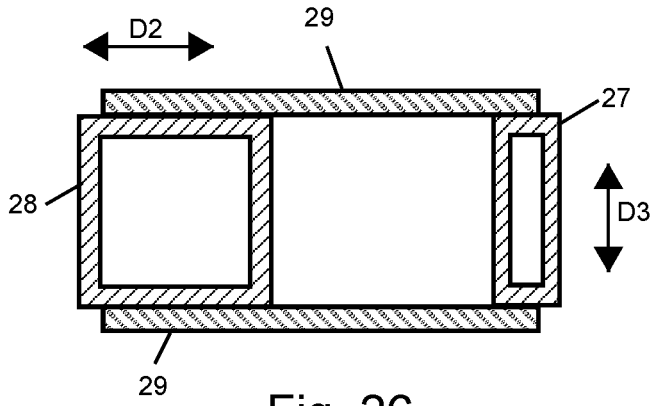
FIG. 26 is a cross-sectional view of a portion of the moment frame illustrated in FIG. 25, along line D-D.

Referring to FIGS. 25 and 26, the modular structure 10 may include vertical structural members 16 formed from multiple components. As shown in the illustrated embodiment, the modular structure 10 may include an inner column 27 and an outer column 28 that both are rigidly connected to at least one horizontal structural member 18. According to one embodiment, the inner column 27 and the outer column 28 may be separated by a gap with respect to a direction perpendicular to the first direction D1. The modular structure 10 may include one or more plates 29 (shown in dashed lines in FIG. 25) rigidly coupled to both the inner column 27 and the outer column 28, thereby forming the vertical structural member 16.

The outer column 28 may define a length measured along the first direction D1 greater than a length of the inner column 27 measured along the first direction D1. The outer column 28 may define a cross-sectional dimension measured along a direction perpendicular to the first direction D1 greater than a cross-sectional dimension of the inner column 27 measured along the same direction perpendicular to the first direction D1. As shown, the inner column 27 the outer column 28, or both the inner column 27 and the outer column 28 may be a tubular member.

The vertical structural member 16 may be rigidly coupled to one or more of the horizontal structural members 18 to form one of the moment frames 24 of the modular structure 10. According to one embodiment, the vertical structural member 16 may be rigidly coupled to the horizontal structural member 18 by (for example) welding: the inner column 27 to the horizontal structural member 18; the outer column 27 to the horizontal structural member 18; the plate 29 to the horizontal structural member 18; or any combination thereof. The vertical structural member 16 may be rigidly coupled to one or more of the horizontal structural members 18 to form the moment frame 24 such that a portion 31 of the outer column 28 extends beyond the horizontal structural member 18 with respect to the first direction D1, and that portion 31 is sized to receive a portion of the connector 30, for example the first body 32 or the second body 52.

Figure 27:
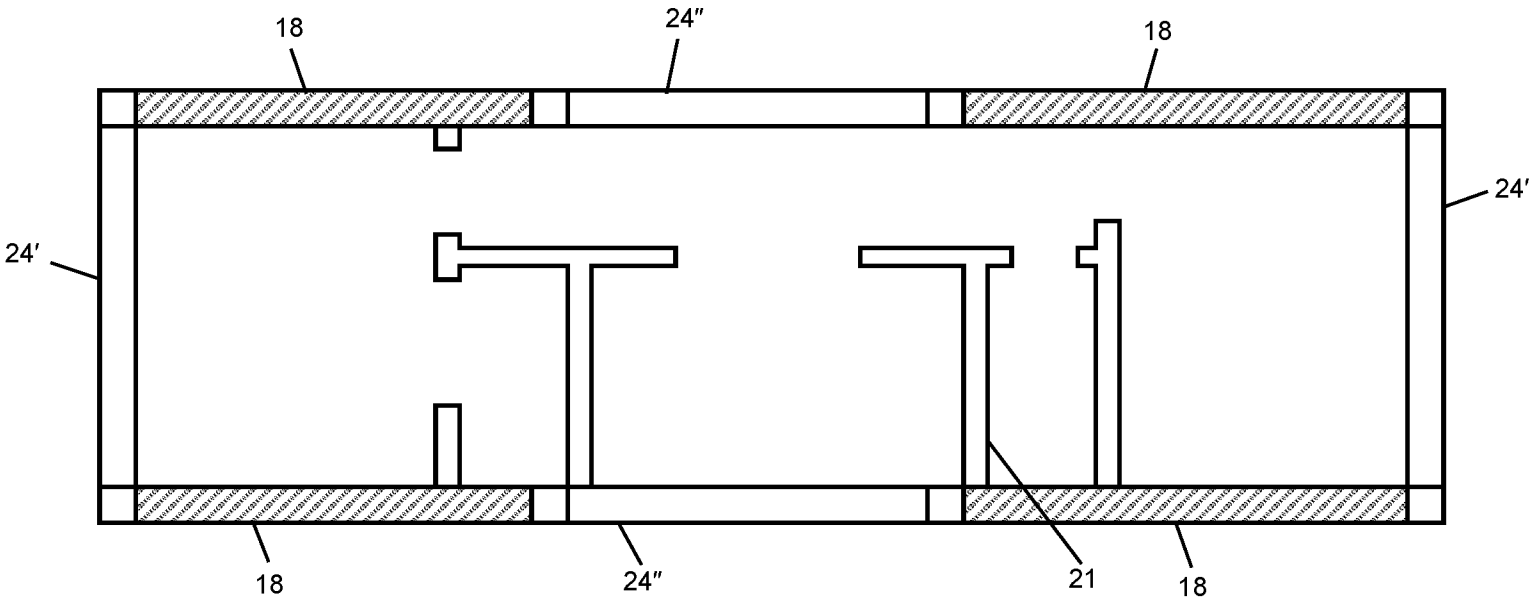
FIG. 27 is a top plan view of a modular structure according to one embodiment.

Referring to FIG. 27, the modular structure 10 may include at least one, for example two, of the moment frames 24' oriented such that the horizontal structural members 18 of the moment frames 24' are elongate along the second direction D2, and the modular structure 10 may further include at least one for example two, of the moment frames 24" oriented such that the horizontal structural members 18 of the moment frames 24" are elongate along the third direction D3. Thus, the modular structure 10 may include moment frames 24 that are oriented perpendicular to one another.

As shown in the illustrated embodiment, the moment frames 24' and the moment frames 24" may be connected by one or more of the horizontal structural members 18 that do not form part of a moment frame. The modular structure 10 may include interior walls 21 extending away from one or more of the moment frames 24', 24".

Referring to FIGS. 2 to 4 and 27, a method of assembling the modular structure 10 may include rigidly connecting a first pair of the vertical structural members 16 to a first pair of the horizontal structural members 18 thereby forming a first moment frame 24. The method may further include rigidly connecting a second pair of the vertical structural members 16 to a second pair of the horizontal structural members 18 thereby forming a second moment frame 24. The method may include connecting the first moment frame 24 to the second moment frame 24 such that the first pair of horizontal structural members 18 are perpendicular to the second pair of horizontal structural members 18.

The method may include rigidly connecting a third pair of the vertical structural members 16 to a third pair of the horizontal structural members 18 thereby forming a third moment frame 24. The method may further include rigidly connecting a fourth pair of the vertical structural members 16 to a fourth pair of the horizontal structural members 18 thereby forming a fourth moment frame 24. The method may include connecting the third moment frame 24 to the first moment frame 24 and the second moment frame 24 such that the third pair of horizontal structural members 18 are perpendicular to the first pair of horizontal structural members 18. The method may include connecting the fourth moment frame 24 to the third moment frame 24 such that the fourth pair of horizontal structural members 18 are perpendicular to the third pair of horizontal structural members 18.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art.

Many of the methods described herein can be performed with variations. For example, many of the methods may include additional acts, omit some acts, and/or perform acts in a different order than as illustrated or described.

The various embodiments described above can be combined to provide further embodiments. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Application No. 62/929,698, filed Nov. 1, 2019 and PCT Application No. PCT/US2019/030465, are incorporated herein by reference, in their entirety. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of assembling a connector, the method comprising:

inserting a first fastener into a first cavity, the first cavity defined by a first body having a base portion and a protrusion that extends away from the base portion along a first direction, wherein inserting the first fastener into the first cavity includes rotating the first fastener about a first fastener central axis relative to the first body;

inserting the protrusion into a second cavity defined by a second body, the second cavity shaped to receive the protrusion such that rotation of the first body relative to the second body is blocked;

inserting a distal portion of a second fastener into a third cavity defined by the first fastener, thereby capturing the second body between the distal portion and a proximal portion of the second fastener, the distal portion opposite the proximal portion with respect to the first direction.

2. The method of claim 1, wherein the protrusion extends away from the base portion in a first vector of the first direction, and inserting the first fastener into the first cavity comprises:

moving the first fastener relative to the first body in a second vector of the first direction, the second vector opposite the first vector.

3. The method of claim 2 wherein the first fastener central axis, is parallel to the first direction, and rotating the first fastener relative to the first body engages first outer threads defined by an outer surface of the first fastener with corresponding first inner threads defined by an inner surface of the first body, and the inner surface establishes a boundary of the first cavity.

4. The method of claim 3 wherein the first fastener includes an inner surface that has second inner threads, the distal portion of the second fastener includes an outer surface that has corresponding second outer threads, and inserting the distal portion of the second fastener into the third cavity comprises:

rotating the second fastener about a second fastener central axis, which is parallel to the first direction, thereby engaging the second inner threads with the corresponding second outer threads.

5. A connector comprising:

a first body having a base portion and a protrusion, the protrusion extending away from the base portion along a first direction, the first body having a first cavity that extends into the protrusion and towards the base portion along the first direction;

a second body having a second cavity, the second cavity shaped to receive the protrusion such that rotation of the first body relative to the second body is blocked;

a first fastener having a third cavity, the first fastener securable to the first body such that an entirety of the first fastener is positioned within the first cavity and such that translation of the first fastener relative to the first body is blocked; and a second fastener having a proximal portion and a distal portion, the distal portion securable within the third cavity such that translation of the first fastener relative to the second fastener is blocked, wherein the connector includes an assembled configuration in which the protrusion is positioned in the second cavity, the first fastener is positioned within the first cavity, and the second fastener is positioned within the third cavity, and when in the assembled configuration translation of the second body relative to the first body along the first direction is blocked.

6. The connector of claim 5 wherein in the assembled configuration the protrusion is positioned within the second cavity such that interference between an outer surface of the protrusion and an inner surface of the second body blocks rotation of the first body relative to the second body, wherein the inner surface establishes a boundary of the second cavity.

7. The connector of claim 5 wherein in the assembled configuration the first fastener is positioned and secured within the first cavity such that translation of the first fastener relative to the first body in the first direction is blocked.

8. The connector of claim 7 wherein the first body includes an inner surface that has threads, the first fastener includes an outer surface that has corresponding threads, and in the assembled configuration engagement of the first body inner surface threads and the corresponding first fastener outer surface threads blocks translation of the first fastener relative to the first body in the first direction.

9. The connector of claim 7 wherein the first body has a first body central axis of the first cavity, the first fastener has a first fastener central axis of the third cavity, and in the assembled configuration the first body central axis and the first fastener central axis are collinear.

10. The connector of claim 5 wherein in the assembled configuration the distal portion of the second fastener is positioned within the third cavity.

11. The connector of claim 10 wherein the first fastener includes an inner surface that has threads, the distal portion of the second fastener includes an outer surface that has corresponding threads, and in the assembled configuration engagement of the first fastener inner surface threads and the corresponding distal portion of the second fastener threads blocks translation of the first fastener relative to the second fastener in the first direction.

12. The connector of claim 10 wherein the first fastener has a first fastener central axis, the second fastener has a second fastener central axis, and in the assembled configuration the first fastener central axis and the second fastener central axis are collinear.

13. The connector of claim 5 wherein in the assembled configuration the second body is captured between the base portion of the first body and the proximal portion of the second fastener with respect to the first direction.

14. The connector of claim 5 wherein the protrusion is first protrusion, the first body further comprises:

a plurality of second protrusions that each extend away from the base portion along either a second direction or a third direction, both the second direction and the third direction being perpendicular to the first direction.

15. The connector of claim 14 wherein:

each of the plurality of second protrusions has one of a plurality of fourth cavities;

each of the plurality of second protrusions extends away from the base portion and terminates at a respective distal tip; and each of the plurality of fourth cavities extends through the distal tip of one of the plurality of second protrusions.

16. The connector of claim 14 wherein the second direction is perpendicular to the third direction.

17. The connector of claim 14, wherein a first of the plurality of second protrusions extends away from the base portion along a first vector of the second direction, and a second of the plurality of second protrusions extends away from the base portion along a second vector of the second direction, wherein the second vector is opposite the first vector.

18. The connector of claim 14 wherein the first cavity extends into the first protrusion, towards the base portion, and terminates at a base surface within the first protrusion.

19. The connector of claim 5, further comprising a collar with a through hole sized to allow passage of the distal portion through the through hole, such that the collar is captured between the proximal portion and the second body.

20. A connector comprising:

a first body having a base portion and a protrusion, the protrusion extending away from the base portion along a first direction, the first body having a first cavity that extends into the protrusion and towards the base portion along the first direction, and the first body includes an inner surface that has threads;

a second body having a second cavity, the second cavity shaped to receive the protrusion such that rotation of the first body relative to the second body is blocked;

a first fastener having a third cavity, the first fastener having an outer surface that has threads that correspond to the threads of the first body, and the first fastener is securable within the first cavity; and a second fastener having a proximal portion and a distal portion, the distal portion securable within the third cavity such that translation of the first fastener relative to the second fastener is blocked, wherein the connector includes an assembled configuration in which the protrusion is positioned in the second cavity, the first fastener is positioned within the first cavity, and the second fastener is positioned within the third cavity, and when in the assembled configuration translation of the second body relative to the first body along the first direction is blocked; and wherein in the assembled configuration the first fastener is positioned and secured within the first cavity such that translation of the first fastener relative to the first body in the first direction is blocked by engagement of the first body inner surface threads and the first fastener outer surface threads.

21. A connector comprising:

a first body having a base portion and a protrusion, the protrusion extending away from the base portion along a first direction, the first body having a first cavity that extends into the protrusion and towards the base portion along the first direction;

a second body having a second cavity, the second cavity shaped to receive the protrusion such that rotation of the first body relative to the second body is blocked;

a third body having a plurality of through holes, each of the plurality of through holes shaped to receive the protrusion;

a first fastener having a third cavity, the first fastener securable within the first cavity such that translation of the first fastener relative to the first body is blocked; and a second fastener having a proximal portion and a distal portion, the distal portion securable within the third cavity such that translation of the first fastener relative to the second fastener is blocked, wherein when the protrusion is positioned in the second cavity, when the first fastener is positioned within the first cavity, and when the second fastener is positioned within the third cavity, translation of the second body relative to the first body along the first direction is blocked.

22. The connector of claim 21, wherein each of the plurality of through holes are shaped to receive the protrusion such that rotation of the first body relative to the third body is blocked.

23. The connector of claim 22, wherein each of the plurality of through holes is identical.

* * * * *